US010519723B2

(12) United States Patent
Huang

(10) Patent No.: US 10,519,723 B2
(45) Date of Patent: Dec. 31, 2019

(54) CUTTING TABLES INCLUDING RIDGE STRUCTURES, RELATED CUTTING ELEMENTS, AND EARTH-BORING TOOLS SO EQUIPPED

(71) Applicant: Baker Hughes, a GE company, LLC, Houston, TX (US)

(72) Inventor: Xu Huang, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

(21) Appl. No.: 15/832,093

(22) Filed: Dec. 5, 2017

(65) Prior Publication Data

US 2019/0169939 A1 Jun. 6, 2019

(51) Int. Cl.

| | |
|---|---|
| ***E21B 10/43*** | (2006.01) |
| ***E21B 10/55*** | (2006.01) |
| ***E21B 10/573*** | (2006.01) |
| *E21B 17/10* | (2006.01) |

(52) U.S. Cl.

CPC ..... *E21B 10/5735* (2013.01); *E21B 10/43* (2013.01); *E21B 10/55* (2013.01); *E21B 17/1092* (2013.01)

(58) Field of Classification Search

CPC ..... E21B 10/5735; E21B 10/43; E21B 10/55; E21B 17/1092

See application file for complete search history.

(56) References Cited

U.S. PATENT DOCUMENTS

| | | | | |
|---|---|---|---|---|
| 4,224,380 | A | 9/1980 | Bovenkerk et al. | |
| 5,127,923 | A | 7/1992 | Bunting et al. | |
| 6,003,623 | A * | 12/1999 | Miess | E21B 10/55 175/426 |
| 6,065,554 | A * | 5/2000 | Taylor | E21B 10/5673 175/430 |
| 6,672,406 | B2 | 1/2004 | Beuershausen | |
| 8,210,288 | B2 * | 7/2012 | Chen | E21B 10/55 175/430 |
| 8,739,904 | B2 * | 6/2014 | Patel | E21B 10/52 175/428 |

* cited by examiner

*Primary Examiner* — David J Bagnell
*Assistant Examiner* — Brandon M Duck
(74) *Attorney, Agent, or Firm* — TraskBritt

(57) ABSTRACT

A cutting table for use in subterranean formations comprises a base structure of hard material and at least one ridge structure of hard material. The base structure comprises a side surface, an upper surface, and a cutting edge between the upper surface and the side surface. The at least one ridge structure vertically extends from the base structure and is positioned horizontally inward of the cutting edge. A cutting element for use in subterranean formations and an earth-boring tool are also described.

14 Claims, 5 Drawing Sheets

CUTTING TABLES INCLUDING RIDGE STRUCTURES, RELATED CUTTING ELEMENTS, AND EARTH-BORING TOOLS SO EQUIPPED

TECHNICAL FIELD

Embodiments of the disclosure relate to cutting tables including ridge structures, and to related cutting elements, earth-boring tools, and methods of forming the cutting tables, cutting elements, and earth-boring tools.

BACKGROUND

Earth-boring tools for forming wellbores in subterranean formations may include cutting elements secured to a body. For example, a fixed-cutter earth-boring rotary drill bit ("drag bit") may include cutting elements fixedly attached to a bit body thereof. As another example, a roller cone earth-boring rotary drill bit may include cutting elements secured to cones mounted on bearing pins extending from legs of a bit body. Other examples of earth-boring tools utilizing cutting elements include, but are not limited to, core bits, bi center bits, eccentric bits, hybrid bits (e.g., rolling components in combination with fixed cutting elements), reamers, and casing milling tools.

Cutting elements used in earth-boring tools often include a supporting substrate and cutting table. The cutting table comprises a volume of superabrasive material, such as a volume of polycrystalline diamond ("PCD") material, on or over the supporting substrate. Surfaces of the cutting table act as cutting surfaces of the cutting element. During a drilling operation, cutting edges at least partially defined by peripheral portions of the cutting surfaces of the cutting elements are pressed into the formation. As the earth-boring tool moves (e.g., rotates) relative to the subterranean formation, the cutting elements drag across surfaces of the subterranean formation and the cutting edges shear away formation material.

During a drilling operation, the cutting elements of an earth-boring tool may be subjected to high temperatures (e.g., due to friction between the cutting table and the subterranean formation being cut), high axial loads (e.g., due to the weight on bit (WOB)), and high impact forces (e.g., due to variations in WOB, formation irregularities, differences in formation materials, vibration). Such conditions can result in undesirable wear (e.g., dulling) and/or damage (e.g., thermal damage, chipping, spalling) to the cutting tables of the cutting elements. The wear and/or damage can cause one or more of decreased cutting efficiency, separation of the cutting tables from the supporting substrates of the cutting elements, and separation of the cutting elements from the earth-boring tool to which they are secured.

Accordingly, it would be desirable to have cutting tables, cutting elements, earth-boring tools (e.g., rotary drill bits), and methods of forming and using the cutting tables, the cutting elements, and the earth-boring tools facilitating enhanced cutting efficiency and prolonged operational life during drilling operations as compared to conventional cutting tables, conventional cutting elements, conventional earth-boring tools, and conventional methods of forming and using the conventional cutting tables, the conventional cutting elements, and the conventional earth-boring tools.

BRIEF SUMMARY

Embodiments described herein include cutting tables including one or more ridge structures, cutting elements including the cutting tables, earth-boring tools including the cutting elements, and methods of forming the cutting tables, cutting elements, and earth-boring tools. For example, in accordance with one embodiment described herein, a cutting table for use in subterranean formations comprises a base structure of hard material and at least one ridge structure of hard material. The base structure comprises a side surface, an upper surface, and a cutting edge between the upper surface and the side surface. The at least one ridge structure vertically extends from the base structure and is positioned horizontally inward of the cutting edge.

In additional embodiments, a cutting element for use in subterranean formations comprises a supporting substrate, and a cutting table over the supporting substrate. The cutting table comprises a base structure of hard material and at least one ridge structure of hard material. The base structure comprises a side surface, an upper surface, and a cutting edge between the upper surface and the side surface. The at least one ridge structure vertically extends from the base structure and is positioned horizontally inward of the cutting edge.

In further embodiments, an earth-boring tool comprises a structure having at least one pocket therein, and at least one cutting element secured within the at least one pocket in the structure. The at least one cutting element comprises a supporting substrate, and a cutting table of hard material over the supporting substrate. The cutting table comprises a base structure and at least one ridge structure. The base structure comprises a side surface, an upper surface, and a cutting edge between the upper surface and the side surface. The at least one ridge structure vertically extends from the base structure and is positioned horizontally inward of the cutting edge.

DETAILED DESCRIPTION

Figure 1A:
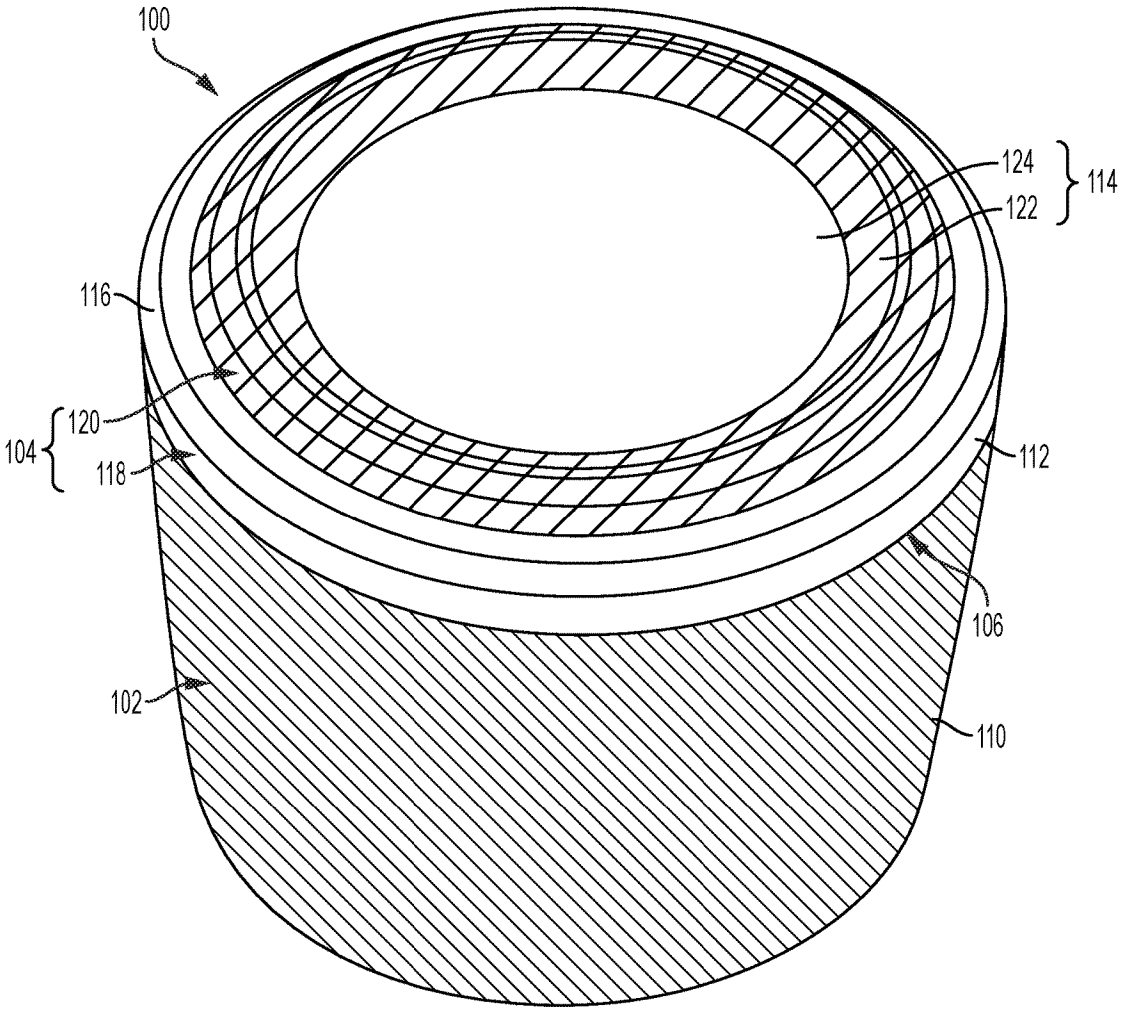
FIGS. 1A and 1B are simplified perspective (FIG. 1A) and cross-sectional (FIG. 1B) views of a cutting element configuration, in accordance with embodiments of the disclosure.

Cutting tables and cutting elements for use in earth-boring tools are described, as are earth-boring tools including the cutting elements, and methods of forming and using the cutting tables, the cutting elements, and the earth-boring tools. In some embodiments, a cutting table includes a base structure and at least one ridge structure vertically extending from the base structure. The ridge structure may be positioned horizontally inward of a cutting edge (e.g., a chamfered cutting edge) of the cutting table. Upper surfaces of the base structure and the ridge structure form a non-planar cutting surface of the cutting table. The ridge structure is configured and positioned to increase the impact resistance of the cutting table, to control spalling damage to the cutting table, and/or to facilitate cooling of relatively higher temperature regions of the cutting table during use and operation of the cutting table. The configurations of the cutting tables, cutting elements, and earth-boring tools described herein may provide enhanced drilling efficiency and improved operational life as compared to the configurations of conventional cutting tables, conventional cutting elements, and conventional earth-boring tools.

The following description provides specific details, such as specific shapes, specific sizes, specific material compositions, and specific processing conditions, in order to provide a thorough description of embodiments of the present disclosure. However, a person of ordinary skill in the art would understand that the embodiments of the disclosure may be practiced without necessarily employing these specific details. Embodiments of the disclosure may be practiced in conjunction with conventional fabrication techniques employed in the industry. In addition, the description provided below does not form a complete process flow for manufacturing a cutting table, a cutting element, or an earth-boring tool. Only those process acts and structures necessary to understand the embodiments of the disclosure are described in detail below. Additional acts to form a complete cutting table, a complete cutting element, or a complete earth-boring tool from the structures described herein may be performed by conventional fabrication processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or descried as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "comprising," "including," "containing," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature, or method act indicates that such is contemplated for use in implementation of an embodiment of the disclosure and such term is used in preference to the more restrictive term "is" so as to avoid any implication that other, compatible materials, structures, features, and methods usable in combination therewith should or must be excluded.

As used herein, the terms "vertical," "longitudinal," "horizontal," and "lateral" and are in reference to a major plane of a substrate in or on which one or more structures and/or features are formed and are not necessarily defined by earth's gravitational field. A "horizontal" or "lateral" direction is a direction that is substantially parallel to the major plane of the substrate, while a "vertical" or "longitudinal" direction is a direction that is substantially perpendicular to the major plane of the substrate. The major plane of the substrate is defined by a surface of the substrate having a relatively large area compared to other surfaces of the substrate.

As used herein, spatially relative terms, such as "beneath," "below," "lower," "bottom," "above," "over," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "over" or "above" or "on" or "on top of" other elements or features would then be oriented "below" or "beneath" or "under" or "on bottom of" the other elements or features. Thus, the term "over" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the term "and/or" includes any and all combinations of one or more of the associated listed items.

As used herein, the term "configured" refers to a size, shape, material composition, material distribution, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, at least 99.9% met, or even 100.0% met.

As used herein, the term "about" in reference to a given parameter is inclusive of the stated value and has the meaning dictated by the context (e.g., it includes the degree of error associated with measurement of the given parameter).

As used herein, the terms "earth-boring tool" and "earth-boring drill bit" mean and include any type of bit or tool used for drilling during the formation or enlargement of a wellbore in a subterranean formation and include, for example, fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

As used herein, the term "polycrystalline compact" means and includes any structure comprising a polycrystalline material formed by a process that involves application of pressure (e.g., compaction) to the precursor material or materials used to form the polycrystalline material. In turn, as used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "inter-granular bond" means and includes any direct atomic bond (e.g., covalent, metallic) between atoms in adjacent grains of hard material.

As used herein, the term "hard material" means and includes any material having a Knoop hardness value of greater than or equal to about 3,000 $Kg_f/mm^2$ (29,420 MPa). Non-limiting examples of hard materials include diamond (e.g., natural diamond, synthetic diamond, or combinations thereof), or cubic boron nitride.

Figure 1B:
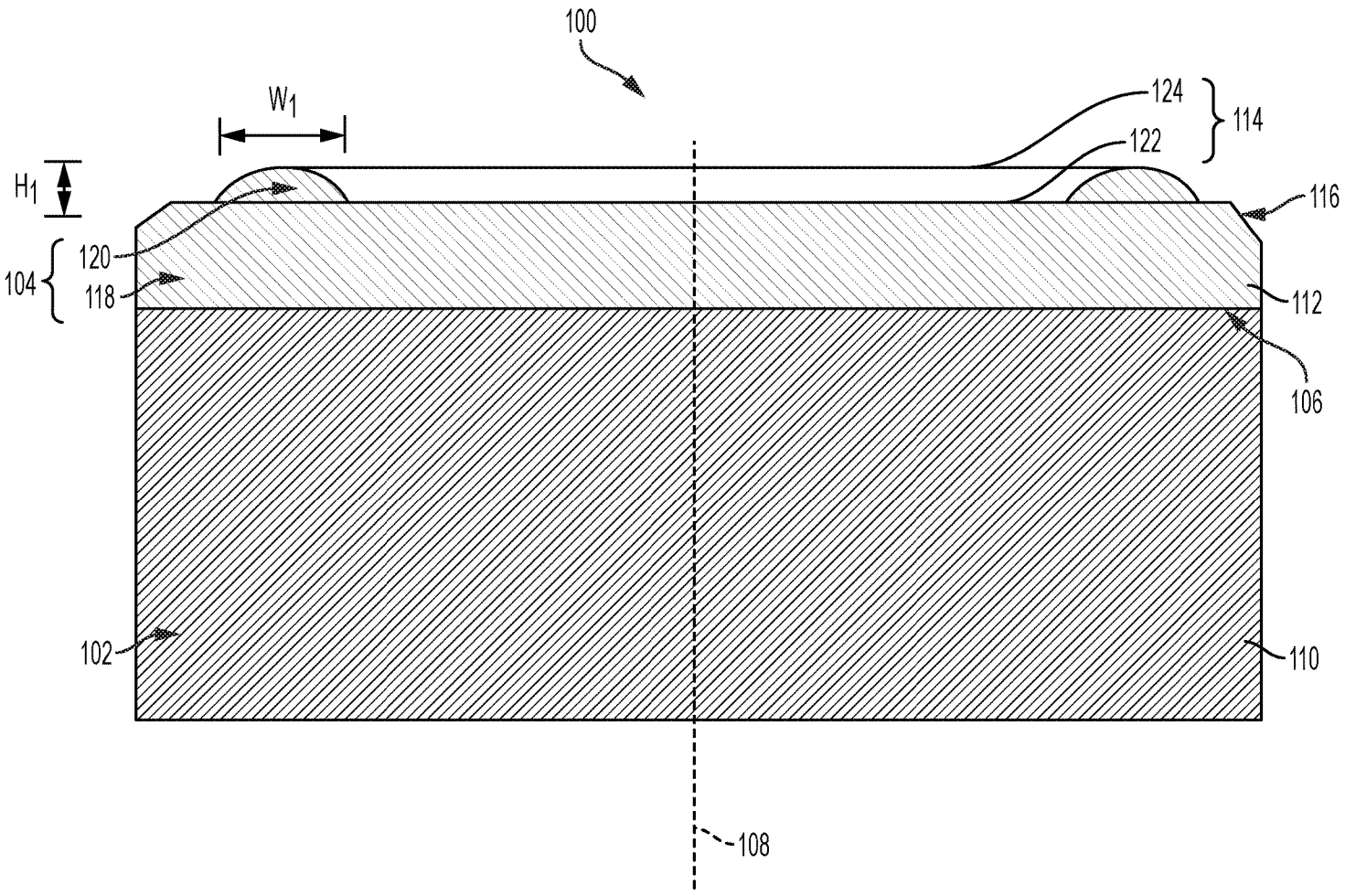

FIG. 1A illustrates a simplified perspective view of cutting element 100 for use in subterranean formations, in accordance with an embodiment of the disclosure. The cutting element 100 includes a supporting substrate 102, and a cutting table 104 attached (e.g., bonded, adhered) to the supporting substrate 102 at an interface 106. FIG. 1B illustrates a simplified cross-sectional view of the cutting element 100 shown in FIG. 1A. While FIGS. 1A and 1B depict a particular cutting element configuration, one of ordinary skill in the art will appreciate that different cutting element configurations are known in the art which may be adapted to be employed in embodiments of the disclosure. Namely, FIGS. 1A and 1B illustrate a non-limiting example of a cutting element configuration of the disclosure.

The supporting substrate 102 may be formed of include a material that is relatively hard and resistant to wear. By way of non-limiting example, the supporting substrate 102 may be formed from and include a ceramic-metal composite material (also referred to as a "cermet" material). In some embodiments, the supporting substrate 102 is formed of and includes a cemented carbide material, such as a cemented tungsten carbide material, in which tungsten carbide particles are cemented together in a metallic binder material. As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide. The metallic binder material may include, for example, a catalyst material such as cobalt, nickel, iron, or alloys and mixtures thereof. In some embodiments, the supporting substrate 102 is formed of and includes a cobalt-cemented tungsten carbide material.

The supporting substrate 102 may exhibit any desired peripheral (e.g., outermost) geometric configuration (e.g., peripheral shape and peripheral size). The supporting substrate 102 may, for example, exhibit a peripheral shape and a peripheral size at least partially complementary to (e.g., substantially similar to) a peripheral geometric configuration of at least a portion of the cutting table 104 thereon or thereover. The peripheral shape and the peripheral size of the supporting substrate 102 may also be configured to permit the supporting substrate 102 to be received within and/or located upon an earth-boring tool, as described in further detail below. By way of non-limiting example, the supporting substrate 102 may exhibit a cylindrical column shape. Referring to FIG. 1B, a vertical axis 108 of the cutting element 100 may extend through a center of the supporting substrate 102 in an orientation at least substantially parallel to a side surface 110 (e.g., a substantially cylindrical side surface) of the supporting substrate 102 (e.g., in an orientation perpendicular to a generally circular cross-section of the supporting substrate 102). The side surface 110 of the supporting substrate 102 may be coextensive and continuous with a side surface 112 (e.g., a substantially cylindrical side surface) of the cutting table 104. In additional embodiments, the supporting substrate 102 may exhibit a different peripheral shape (e.g., a conical shape; a frustoconical shape; truncated versions thereof; or an irregular shape, such as a complex shape complementary to both of the cutting table 104 thereon or thereover and a recess or socket in an earth-boring tool to receive and hold the supporting substrate 102). In addition, the interface 106 between the supporting substrate 102 and the cutting table 104 (and, hence, opposing surfaces of the supporting substrate 102 and the cutting table 104) may be substantially planar, or may be non-planar (e.g., curved, angled, jagged, sinusoidal, V-shaped, U-shaped, irregularly shaped, combinations thereof).

Referring again to FIG. 1A, the cutting table 104 may be positioned on or over the supporting substrate 102, and may include the side surface 112 (e.g., cylindrical side surface, cylindrical barrel wall), a non-planar cutting surface 114 (e.g., top surface, uppermost surface) opposite the interface 106 between the supporting substrate 102 and the cutting table 104, and a chamfered cutting edge 116 between the side surface 112 and the non-planar cutting surface 114. In some embodiments, the chamfered cutting edge 116 includes a single (e.g., only one) chamfer surface. In additional embodiments, the chamfered cutting edge 116 includes multiple (e.g., more than one) chamfer surfaces, and the multiple chamfer surfaces may be oriented at different chamfer angles than from one another. In further embodiments, in lieu of the chamfered cutting edge 116, one or more edges of the cutting table 104 are radiused (e.g., rounded, curved), or comprise a combination of at least one chamfer surface and at least one arcuate (e.g., curved, radiused, rounded) surface. While FIGS. 1A and 1B depict a particular cutting table configuration, one of ordinary skill in the art will appreciate that different cutting table configurations are known in the art, which may be adapted to be employed in embodiments of the disclosure. Namely, FIGS. 1A and 1B illustrate a non-limiting example of a cutting table configuration of the disclosure.

With continued reference to FIG. 1A, the cutting table 104 includes a base structure 118 and at least one ridge structure 120 vertically projecting (e.g., vertically extending) from the base structure 118. The base structure 118 may be integral and continuous with the ridge structure 120, such that the cutting table 104 comprises a substantially monolithic structure. As used herein, the term "monolithic structure" means and includes a structure formed as, and comprising a single (e.g., only one), unitary structure of a material. The cutting table 104 may not, for example, exhibit joint structures (e.g., braze joints, diamond layer joints) intervening between and coupling the base structure 118 and the ridge structure 120. In additional embodiments, the ridge structure 120 is connected (e.g., coupled, bonded, adhered, attached, etc.) to the base structure 118 through one or more joint structures. As shown in FIG. 1A, an upper surface 122 of the base structure 118 and an upper surface 124 of the ridge structure 120 may, in combination, define the non-planar cutting surface 114 of the cutting table 104.

The base structure 118 of the cutting table 104 vertically intervenes between the supporting substrate 102 and the ridge structure 120 of the cutting table 104. The base structure 118 may substantially define the side surface 112 and the chamfered cutting edge 116 of the cutting table 104, and may partially define the cutting surface 114 of the cutting table 104. In some embodiments, the base structure 118 exhibits a generally cylindrical column shape. In additional embodiments, the base structure 118 exhibits a different geometric configuration, such as a dome shape, a conical shape, a frusto conical shape, a rectangular column shape, a pyramidal shape, a frusto pyramidal shape, a fin shape, a pillar shape, a stud shape, or an irregular shape.

The ridge structure 120 of the cutting table 104 may impart the cutting table 104 with enhanced impact resistance as compared to conventional cutting tables. In addition, the ridge structure 120 may impede (e.g., hinder, obstruct) horizontal crack propagation therethrough, and may effectuate fracture of the cutting table 104 at or proximate horizontal boundaries of the ridge structure 120 after the chamfered cutting edge 116 has been subjected to a predetermined amount of wear. The ridge structure 120 may, for example, effectuate stress concentrations within the cutting table 104 that increase the probability that the cutting table 104 will fracture at or proximate the ridge structure 120 after the cutting table 104 is subject to a predetermined amount of wear. Moreover, the geometric configuration (e.g., shape, size) and position (e.g., horizontal position) of the ridge structure 120 may facilitate aggressive engagement of a subterranean formation by the cutting table 104 during use and operation of the cutting element 100, and may also facilitate desirable cooling of the cutting table 104 during use and operation of the cutting element 100 by providing additional thermal mass and surface area for heat transfer away from the chamfered cutting edge 116.

As shown in FIG. 1B, the ridge structure 120 of the cutting table 104 may have an at least partially (e.g., substantially) arcuate (e.g., curved, radiused, non-linear) vertical cross-sectional shape. The upper surface 124 of the ridge structure 120 may, for example, comprise at least one arcuate surface, such that the vertical cross-sectional shape of the ridge structure 120 exhibits at least one arcuate section. The at least partially arcuate vertical cross-sectional shape of the ridge structure 120 may exhibit a single (e.g., only one) radius of curvature, or may exhibit multiple (e.g., more than one) radiuses of curvature. In some embodiments, the ridge structure 120 exhibits a semi-circular vertical cross-sectional shape. In additional embodiments, the ridge structure 120 exhibits a different arcuate vertical cross-sectional shape, such as a semi-ovular vertical cross-sectional shape, a semi-ellipsoidal vertical cross-sectional shape, or an irregular arcuate vertical cross-sectional shape. In further embodiments, the ridge structure 120 exhibits an at least partially non-arcuate (e.g., non-curved, linear) vertical cross-sectional shape. The upper surface 124 of the ridge structure 120 may, for example, include at least one chamfer surface, such that the vertical cross-sectional shape of the ridge structure 120 exhibits at least one linear section. If the upper surface 124 of the ridge structure 120 includes multiple chamfer surfaces, the multiple chamfer surfaces may be oriented at different chamfer angles than one another. Accordingly, the at least partially non-arcuate vertical cross-sectional shape of the ridge structure 120 may include multiple linear sections oriented at different angles than one another. In additional embodiments, the ridge structure 120 has a vertical cross-sectional shape exhibiting a combination of arcuate sections and linear sections. The upper surface 124 of the ridge structure 120 may, for example, include at least one arcuate surface and at least one chamfer surface.

The ridge structure 120 of the cutting table 104 may exhibit any vertical cross-sectional dimensions (e.g., vertical cross-sectional width, vertical cross-sectional height) providing the cutting table 104 with desired characteristics (e.g., impact resistance characteristics, fracture characteristics, cooling characteristics) during use and operation of the cutting element 100. As shown in FIG. 1B, the ridge structure 120 may, for example, exhibit a vertical cross-sectional width $W_1$ greater than or equal to a vertical cross-sectional width of the chamfered cutting edge 116 of the cutting table 104, and a vertical cross-sectional height $H_1$ less than or equal to a vertical cross-sectional height of the chamfered cutting edge 116 of the cutting table 104. By way of non-limiting example, the vertical cross-sectional width $W_1$ of the ridge structure 120 may be within a range of from about one time (1×) to about ten times (10×) the vertical cross-sectional width of the chamfered cutting edge 116 of the cutting table 104, and the vertical cross-sectional height $H_1$ of the ridge structure 120 may be within a range of from about one fourth times (0.25×) to about three times (3×) the vertical cross-sectional height of the chamfered cutting edge 116 of the cutting table 104. In some embodiments, the vertical cross-sectional width $W_1$ of the ridge structure 120 is less than or equal to about 4 mm (e.g., within a range of from about 0.4 mm to about 4 mm), and the vertical cross-sectional height $H_1$ of the ridge structure 120 is less than or equal to about 2 mm (e.g., within a range of from about 0.2 mm to about 2 mm).

The ridge structure 120 may exhibit a non-variable (e.g., constant, uniform) vertical cross-sectional shape and non-variable (e.g., constant, uniform) vertical cross-sectional dimensions. For example, portions of the ridge structure 120 at different positions along a path (e.g., an arcuate path) followed by the ridge structure 120 may each exhibit substantially the same vertical cross-sectional shape and substantially the same vertical cross-sectional dimensions as one another. In additional embodiments, the ridge structure 120 exhibits variable (e.g., non-constant, non-uniform) vertical cross-sectional shapes and/or variable (e.g., non-constant, non-uniform) vertical cross-sectional dimensions. For example, portions of the ridge structure 120 at different positions along the path followed by the ridge structure 120 may exhibit different vertical cross-sectional shapes than one another, and/or one or more different vertical cross-sectional dimensions than one another.

Referring to FIG. 1A, the ridge structure 120 of the cutting table 104 may extend continuously in an arcuate path (e.g., a curved path) across uppermost boundaries of the base structure 118 of the cutting table 104. In some embodiments, the arcuate path of the ridge structure 120 continuously extends substantially parallel to the circumference (e.g., outermost horizontal boundaries) of the cutting table 104. The curvature of the arcuate path of the ridge structure 120 between different circumferential positions on the cutting table 104 may be substantially the same as the curvature of the side surface 112 of the cutting table 104 between the different circumferential positions. As shown in FIG. 1A, in some embodiments, the ridge structure 120 has a circular annular shape exhibiting a curvature substantially similar to the curvature of the side surface 112 of the cutting table 104 along a horizontal plane perpendicular to the vertical axis 108 (see FIG. 1B). In additional embodiments, the ridge structure 120 continuously extends in a different arcuate path than that shown in FIG. 1A. The different arcuate path of the ridge structure 120 may, for example, be oriented and continuously extend at least partially (e.g., substantially) non-parallel to the circumference of the cutting table 104. The curvature of the different arcuate path of the ridge structure 120 between at least two (2) different circumferential positions on the cutting table 104 may be different than the curvature of the side surface 112 of the cutting table 104 between the at least two (2) different circumferential positions. In some such embodiments, the ridge structure 120 exhibits an elliptical annular shape having a curvature at least partially different than the curvature of the side surface 112 of the cutting table 104 along a horizontal plane perpendicular to the vertical axis 108.

The ridge structure 120 of the cutting table 104 may be spaced apart (e.g., separated) from the chamfered cutting edge 116 of the cutting table 104 by any distance providing the cutting table 104 with desired characteristics (e.g., impact resistance characteristics, fracture characteristics, cooling characteristics) during use and operation of the cutting element 100. The ridge structure 120 may, for example, be spaced apart from the chamfered cutting edge 116 by a distance greater than or equal to about one-fourth (¼) the vertical cross-sectional width of the chamfered cutting edge 116 (e.g., greater than or equal to about one-half (½) the vertical cross-sectional width of the chamfered cutting edge 116, greater than or equal to the vertical cross-sectional width of the chamfered cutting edge 116). In some embodiments, the ridge structure 120 is spaced apart from the chamfered cutting edge 116 by a distance less than or equal to about 5 mm (e.g., within a range of from about 0.5 mm to about 5 mm).

As shown in FIGS. 1A and 1B, portions of the upper surface 122 of the base structure 118 of the cutting table 104 horizontally inward of and horizontally outward of the upper surface 124 of the ridge structure 120 may be substantially planar. In addition, the portion(s) of the upper surface 122 of the base structure 118 horizontally inward of the upper surface 124 of the ridge structure 120 may be substantially coplanar with the portion(s) of the upper surface 122 of the base structure 118 horizontally outward of the upper surface 124 of the ridge structure 120. In additional embodiments, the portion(s) of the upper surface 122 of the base structure 118 horizontally inward of the upper surface 124 of the ridge structure 120 are at least partially (e.g., substantially) non-planar, and/or the portion(s) of the upper surface 122 of the base structure 118 horizontally outward of the upper surface 124 of the ridge structure 120 are at least partially (e.g., substantially) non-planar. For example, the portion(s) of the upper surface 122 of the base structure 118 horizontally inward of the upper surface 124 of the ridge structure 120 may be arcuate (e.g., concave, convex, or a combination thereof), and/or the portion(s) of the upper surface 122 of the base structure 118 horizontally outward of the upper surface 124 of the ridge structure 120 may be arcuate (e.g., concave, convex, or a combination thereof). In further embodiments, the portion(s) of the upper surface 122 of the base structure 118 horizontally inward of the upper surface 124 of the ridge structure 120 may be at least partially non-coplanar with the portion(s) of the upper surface 122 of the base structure 118 horizontally outward of the upper surface 124 of the ridge structure 120. For example, the portion(s) of the upper surface 122 of the base structure 118 horizontally inward of the upper surface 124 of the ridge structure 120 may be vertically offset from (e.g., vertically overlie, vertically underlie) the portion(s) of the upper surface 122 of the base structure 118 horizontally outward of the upper surface 124 of the ridge structure 120.

The cutting table 104 may be formed of and include at least one hard material, such as at least one polycrystalline material. In some embodiments, the cutting table 104 is formed of and includes a PCD material. For example, the cutting table 104 may be formed from diamond particles (also known as "diamond grit") mutually bonded in the presence of at least one catalyst material (e.g., at least one Group VIII metal, such as one or more of cobalt, nickel, and iron; at least one alloy including a Group VIII metal, such as one or more of a cobalt-iron alloy, a cobalt-manganese alloy, a cobalt-nickel alloy, a cobalt-titanium alloy, a cobalt-nickel-vanadium alloy, an iron-nickel alloy, an iron-nickel-chromium alloy, an iron-manganese alloy, an iron-silicon alloy, a nickel-chromium alloy, and a nickel-manganese alloy; combinations thereof etc.). Other catalyst materials, for example, carbonate catalysts, may also be employed. The diamond particles may comprise one or more of natural diamond and synthetic diamond, and may include a mono-modal distribution or a multimodal distribution of particle sizes. In additional embodiments, the cutting table 104 is formed of and includes a different polycrystalline material, such as one or more of polycrystalline cubic boron nitride, a carbon nitride, and other hard materials known in the art.

The base structure 118 of the cutting table 104 may exhibit a microstructure substantially similar to (e.g., having substantially the same average grain size, and substantially the same grain size distribution) that of the ridge structure 120 of the cutting table 104, or the base structure 118 of the cutting table 104 may exhibit a microstructure at least partially different than (e.g., having a different average grain size, and/or a different grain size distribution) that of the ridge structure 120 of the cutting table 104. For example, the base structure 118 may include interspersed and inter-bonded grains of hard material (e.g., inter-bonded diamond grains) having a different average grain size (e.g., a larger average grain size, or a smaller average grain size) than interspersed and inter-bonded grains of hard material (e.g., inter-bonded diamond grains) of the ridge structure 120, and/or the base structure 118 and the ridge structure 120 may include different dispersions (e.g., different mono-modal dispersions, different multi-modal dispersions, a mono-modal dispersion versus a multi-modal dispersion) of the interspersed and inter-bonded grains of hard material thereof. The base structure 118 may exhibit a different volume percentage (e.g., a greater volume percentage, or a lower volume percentage) of hard material than the ridge structure 120, and/or may have different a permeability (e.g., a reduced permeability, or a greater permeability) than the ridge structure 120. In some embodiments, the base structure 118 and the ridge structure 120 exhibit substantially the same volume percentage of hard material as one another. In additional embodiments, the base structure 118 exhibits a lower volume percentage of hard material than the ridge structure 120. In further embodiments, the base structure 118 exhibits a higher volume percentage of hard material than the ridge structure 120.

The cutting table 104 may also include one or more regions where catalyst material (e.g., Co, Fe, Ni, another element from Group VIIIA of the Periodic Table of the Elements, alloys thereof, combinations thereof, etc.) is not present within interstitial spaces between inter-bonded particles (e.g., inter-bonded diamond particles) of the hard material thereof. The catalyst material may, for example, have been removed (e.g., leached) from the one or more regions following the formation of the cutting table 104, as described in further detail below. The regions free of catalyst material may enhance the thermal stability of the cutting table 104 relative to cutting table configurations not including the regions free of catalyst material. By way of non-limiting example, one or more of the base structure 118 and the ridge structure 120 of the cutting table 104 may be at least partially free of catalyst material. In some embodiments, portions of the base structure 118 and the ridge structure 120 proximate the non-planar cutting surface 114 of the cutting table 104 are substantially free of catalyst material. In additional embodiments, the ridge structure 120 is substantially free of catalyst material, but at least a portion (e.g., an entirety, or less than an entirety) of the base structure 118 includes catalyst material within interstitial spaces between inter-bonded particles of the hard material thereof.

The cutting table 104 may be formed using one or more pressing processes. As a non-limiting example, particles (e.g., grains, crystals, etc.) formed of and including one or more hard materials may be provided within a container having a shape complementary to that of the cutting table 104. Thereafter, the particles may be subjected to a high temperature, high pressure (HTHP) process in the presence of catalyst material to sinter the particles and form the cutting table 104. One example of an HTHP process for forming the preliminary cutting table may comprise pressing the plurality of particles within the container using a heated press at a pressure of greater than about 5.0 gigapascals (GPa) and at temperatures greater than about 1,400° C., although the exact operating parameters of HTHP processes will vary depending on the particular compositions and quantities of the various materials being used. The pressures in the heated press may be greater than about 6.5 GPa (e.g., about 7 GPa), and may even exceed 8.0 GPa in some embodiments. Furthermore, the material (e.g., particles) being sintered may be held at such temperatures and pressures for a time period between about 30 seconds and about 20 minutes. Following the HTHP process, the cutting table 104 may, optionally, be exposed to a leaching agent for a sufficient period of time to remove catalyst material from one or more portions thereof. Suitable leaching agents are known in the art and described more fully in, for example, U.S. Pat. No. 5,127,923 to Bunting et al. (issued Jul. 7, 1992), and U.S. Pat. No. 4,224,380 to Bovenkerk et al. (issued Sep. 23, 1980), the disclosure of each of which is incorporated herein in its entirety by this reference. By way of non-limiting example, at least one of aqua regia (i.e., a mixture of concentrated nitric acid and concentrated hydrochloric acid), boiling hydrochloric acid, and boiling hydrofluoric acid may be employed as a leaching agent. In some embodiments, the leaching agent may comprise hydrochloric acid at a temperature greater than or equal to about 110° C. The leaching agent, if employed, may be provided in contact with the cutting table 104 for a period of from about 30 minutes to about 60 hours.

The supporting substrate 102 may be attached to the cutting table 104 during or after the formation of the cutting table 104. In some embodiments, the supporting substrate 102 is attached to the cutting table 104 during the formation of the cutting table 104. For example, particles formed of and including one or more hard materials may be provided within a container having a shape complementary to the cutting table 104 to be formed, the supporting substrate 102 may be provided over the particles, and then particles and the supporting substrate 102 may be subjected to an HTHP process to form the cutting table 104 attached to the supporting substrate 102. In additional embodiments, the supporting substrate 102 is attached to the cutting table 104 after the formation of the cutting table 104. For example, the cutting table 104 may be formed separate from the supporting substrate 102, and then the cutting table 104 may be attached to the supporting substrate 102 through one or more additional processes (e.g., additional HTHP processes, brazing, etc.) to form the cutting element 100.

As previously discussed, while FIGS. 1A and 1B depict a particular configuration of the cutting element 100, including a particular configuration of the cutting table 104 thereof (e.g., including particular configurations of the ridge structure 120 and the base structure 118), different configurations may be employed. By way of non-limiting example, in accordance with additional embodiments of the disclosure, FIGS. 2 through 5 show top-down views of cutting elements exhibiting different configurations than that of the cutting element 100 shown in FIGS. 1A and 1B. Throughout the remaining description and the accompanying figures, functionally similar features (e.g., structures) are referred to with similar reference numerals incremented by 100. To avoid repetition, not all features shown in FIGS. 2 through 5 are described in detail herein. Rather, unless described otherwise below, a feature designated by a reference numeral that is a 100 increment of the reference numeral of a previously-described feature (whether the previously-described feature is first described before the present paragraph, or is first described after the present paragraph) will be understood to be substantially similar to the previously-described feature.

Figure 2:
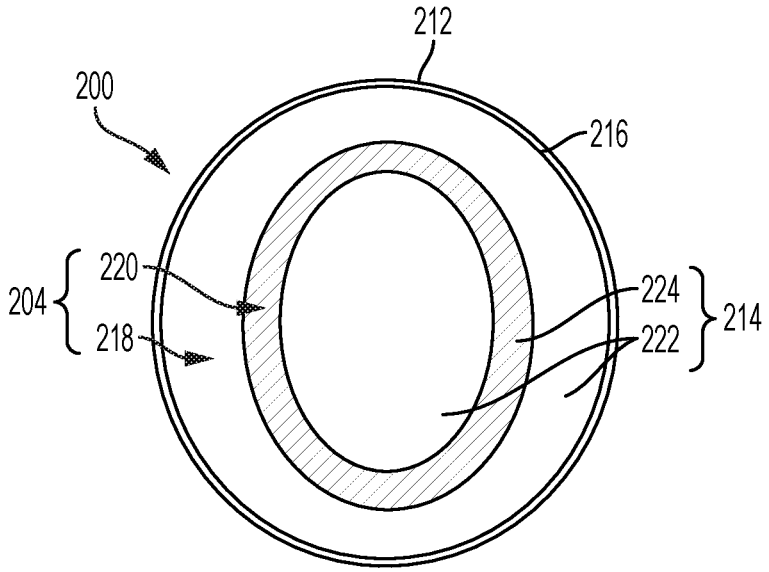
FIGS. 2 through 5 are top-down views of additional cutting element configurations, in accordance with additional embodiments of the disclosure.

FIG. 2 illustrates a simplified top-down view of a cutting element 200 including a cutting table 204, in accordance with another embodiment of the disclosure. The cutting element 200 is similar to the cutting element 100 shown in FIGS. 1A and 1B, but the cutting table 204 of the cutting element 200 includes a ridge structure 220 extending across an upper boundary of a base structure 218 of the cutting table 204 in an arcuate path oriented non-parallel to the circumference of the cutting table 204. As shown in FIG. 2, the ridge structure 220 may have an elliptical annular shape exhibiting a curvature different than the curvature of a side surface 212 of the cutting table 204 along a horizontal plane perpendicular to a vertical axis of the cutting element 200. The ridge structure 220 of the cutting table 204 may be non-uniformly (e.g., non-evenly, variably) spaced apart (e.g., separated) from a chamfered cutting edge 216 of the cutting table 204. Portions of the ridge structure 220 at different positions along the arcuate path followed thereby may each exhibit substantially the same vertical cross-sectional shape and substantially the same vertical cross-sectional dimensions as one another, or portions of the ridge structure 220 at different positions along the arcuate path followed thereby may exhibit different vertical cross-sectional shapes than one another and/or one or more different vertical cross-sectional dimensions than one another. In addition, portions of an upper surface 222 of the base structure 218 of the cutting table 204 horizontally inward of and horizontally outward of an upper surface 224 of the ridge structure 220 may be substantially planar and may be substantially coplanar with one another; or portions of the upper surface 222 of the base structure 218 horizontally inward of and/or horizontally outward of the upper surface 224 of the ridge structure 220 may be at least partially (e.g., substantially) non-planar and/or may be non-coplanar with one another. In further embodiments, the ridge structure 220 extends in a different non-linear path (e.g., a different arcuate path, a different annular path, an angled path, a jagged path, a sinusoidal path, a V-shaped path, a U-shaped path, an irregularly shaped path, a combination thereof, etc.) than that shown in FIG. 2.

Figure 3:
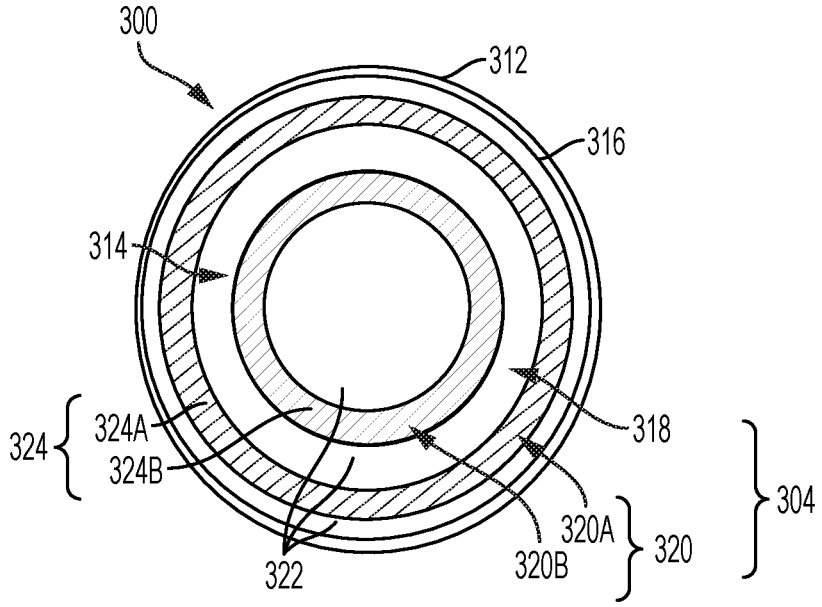

FIG. 3 illustrates a simplified top-down view of a cutting element 300 including a cutting table 304, in accordance with another embodiment of the disclosure. The cutting element 300 is similar to the cutting element 100 shown in FIGS. 1A and 1B, but the cutting table 304 of the cutting element 300 includes ridge structures 320 located at different radial positions than one another. For example, as shown in FIG. 3, the cutting table 304 may include a first ridge structure 320A and a second ridge structure 320B positioned radially inward of the first ridge structure 320A. The first ridge structure 320A may circumferentially extend substantially continuously along a first radial position, and the second ridge structure 320B may circumferentially extend substantially continuously along a second radial position located radially inward of the first radial position. The first ridge structure 320A may substantially completely radially circumscribe the second ridge structure 320B.

Portions of the first ridge structure 320A at different positions along the arcuate path followed thereby may each exhibit substantially the same vertical cross-sectional shape and substantially the same vertical cross-sectional dimensions as one another, or portions of the first ridge structure 320A at different positions along the arcuate path followed thereby may exhibit different vertical cross-sectional shapes than one another and/or one or more different vertical cross-sectional dimensions than one another. In addition, portions of the second ridge structure 320B at different positions along the arcuate path followed thereby may each exhibit substantially the same vertical cross-sectional shape and substantially the same vertical cross-sectional dimensions as one another, or portions of the second ridge structure 320B at different positions along the arcuate path followed thereby may exhibit different vertical cross-sectional shapes than one another and/or one or more different vertical cross-sectional dimensions than one another. The first ridge structure 320A and the second ridge structure 320B may exhibit substantially the same vertical cross-sectional shape and substantially the same vertical cross-sectional dimensions as one another at each shared (e.g., common) circumferential position along the cutting table 304, or the first ridge structure 320A may exhibit a different vertical cross-sectional shape and/or one or more different vertical cross-sectional dimensions than the second ridge structure 320B at one or more shared circumferential positions along the cutting table 304.

The first ridge structure 320A may be uniformly (e.g., evenly, non-variably) spaced apart (e.g., separated) from the second ridge structure 320B by any suitable distance, such as a distance greater than or equal to about one-half (½) a vertical cross-sectional width of a chamfered cutting edge 316 (e.g., greater than or equal to the vertical cross-sectional width of the chamfered cutting edge 316) of the cutting table 304. In some embodiments, the first ridge structure 320A is uniformly spaced apart from the second ridge structure 320B by a distance less than or equal to about 5 mm (e.g., within a range of from about 2 mm to about 5 mm). In addition, portions of an upper surface 322 of the base structure 318 may be positioned radially outward of a first upper surface 324A of the first ridge structure 320A, radially between the first upper surface 324A of the first ridge structure 320A and an second upper surface 324B of the second ridge structure 320B, and radially inward of the second upper surface 324B of the second ridge structure 320B. Each of the different portions of the upper surface 322 of the base structure 318 may be substantially planar and may be substantially coplanar with one another; or two or more of the different portions of the upper surface 322 of the base structure 318 may be at least partially (e.g., substantially) non-planar and/or may be non-coplanar with one another.

In further embodiments, the cutting table 304 of the cutting element 300 may include at least one additional ridge structure located at one or more different radial positions than the first ridge structure 320A and the second ridge structure 320B. For example, the cutting table 304 may include an additional ridge structure positioned radially outward of the first ridge structure 320A, an additional ridge structure positioned radially between the first ridge structure 320A and the second ridge structure 320B, and/or an additional ridge structure positioned radially inward of the second ridge structure 320B.

Figure 4:
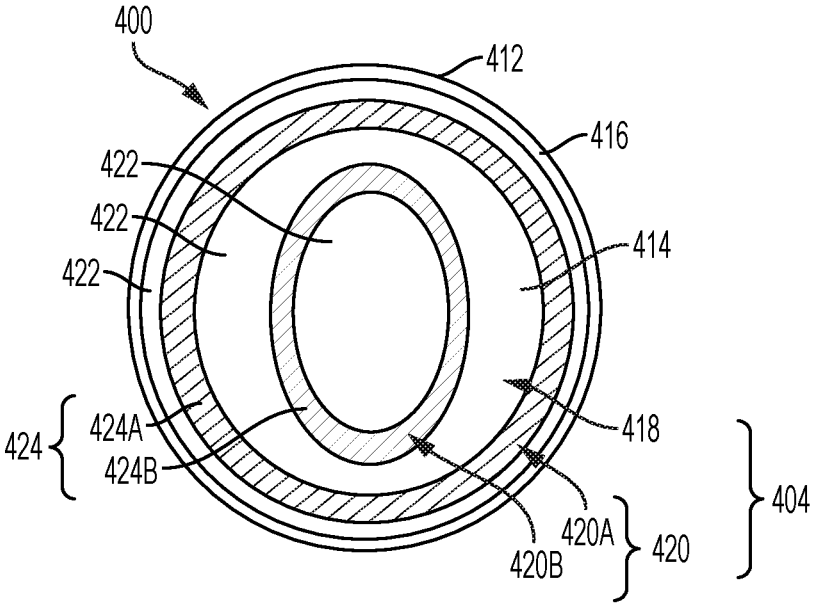

FIG. 4 illustrates a simplified top-down view of a cutting element 400 including a cutting table 404, in accordance with another embodiment of the disclosure. The cutting element 400 is similar to the cutting element 300 shown in FIG. 3, but the cutting table 404 of the cutting element 400 includes ridge structures 420 extending across an upper boundary of a base structure 418 of the cutting table 404 in arcuate paths having different curvature characteristics than one another. A first ridge structure 420A of the cutting table 404 may extend across the upper boundary of the base structure 418 in an arcuate path oriented parallel to a circumference of the cutting table 404, and a second ridge structure 420B may be positioned horizontally inward of the first ridge structure 420A and may extend across the upper boundary of the base structure 418 in an arcuate path oriented non-parallel to a circumference of the cutting table 404. As shown in FIG. 4, in some embodiments, the first ridge structure 420A has a circular annular shape exhibiting a curvature substantially the same as the curvature of a side surface 412 of the cutting table 404 along a horizontal plane perpendicular to a vertical axis of the cutting element 400; and the second ridge structure 420B has an elliptical annular shape exhibiting a curvature different than the curvature of a side surface 412 of the cutting table 404 along the horizontal plane perpendicular to the vertical axis of the cutting element 400. The first ridge structure 420A may substantially completely horizontally circumscribe the second ridge structure 420B.

Portions of the first ridge structure 420A at different positions along the arcuate path followed thereby may each exhibit substantially the same vertical cross-sectional shape and substantially the same vertical cross-sectional dimensions as one another, or portions of the first ridge structure 420A at different positions along the arcuate path followed thereby may exhibit different vertical cross-sectional shapes than one another and/or one or more different vertical cross-sectional dimensions than one another. In addition, portions of the second ridge structure 420B at different positions along the arcuate path followed thereby may each exhibit substantially the same vertical cross-sectional shape and substantially the same vertical cross-sectional dimensions as one another, or portions of the second ridge structure 420B at different positions along the arcuate path followed thereby may exhibit different vertical cross-sectional shapes than one another and/or one or more different vertical cross-sectional dimensions than one another. The first ridge structure 420A and the second ridge structure 420B may exhibit a different vertical cross-sectional shape and/or one or more different vertical cross-sectional dimensions than the second ridge structure 420B at one or more shared circumferential positions along the cutting table 404.

The first ridge structure 420A may be non-uniformly (e.g., non-evenly, variably) spaced apart (e.g., separated) from the second ridge structure 420B by any suitable distances, such as two or more different distances greater than or equal to about one-half (½) a vertical cross-sectional width of a chamfered cutting edge 416 (e.g., greater than or equal to the vertical cross-sectional width of the chamfered cutting edge 416) of the cutting table 404. In addition, portions of an upper surface 422 of the base structure 418 may be positioned horizontally outward of a first upper surface 424A of the first ridge structure 420A, horizontally between the first upper surface 424A of the first ridge structure 420A and a second upper surface 424B of the second ridge structure 420B, and horizontally inward of the second upper surface 424B of the second ridge structure 420B. Each of the different portions of the upper surface 422 of the base structure 418 may be substantially planar and may be substantially coplanar with one another; or two or more the different portions of the upper surface 422 of the base structure 418 may be at least partially (e.g., substantially) non-planar and/or may be non-coplanar with one another.

In further embodiments, one or more of the first ridge structure 420A and the second ridge structure 420B of the cutting table 404 exhibits a different configuration than that depicted in FIG. 4. For example, the first ridge structure 420A may exhibit an elliptical annular shape, and the second ridge structure 420B may exhibit a circular annular shape substantially completely horizontally circumscribed by the first ridge structure 420A. As another example, the first ridge structure 420A may exhibit an elliptical annular shape, and the second ridge structure 420B may exhibit a different elliptical annular shape substantially completely horizontally circumscribed by the first ridge structure 420A. As yet another example, the first ridge structure 420A may exhibit a non-linear shape (e.g., an arcuate shape) only partially horizontally circumscribing a non-linear shape (e.g., another arcuate shape) of the second ridge structure 420B. In further embodiments, the cutting table 404 of the cutting element 400 may include at least one additional ridge structure located at one or more different horizontal positions than the first ridge structure 420A and the second ridge structure 420B. For example, the cutting table 404 may include an additional ridge structure positioned horizontally outward of the first ridge structure 420A, an additional ridge structure positioned horizontally between the first ridge structure 420A and the second ridge structure 420B, and/or an additional ridge structure positioned horizontally inward of the second ridge structure 420B.

Figure 5:
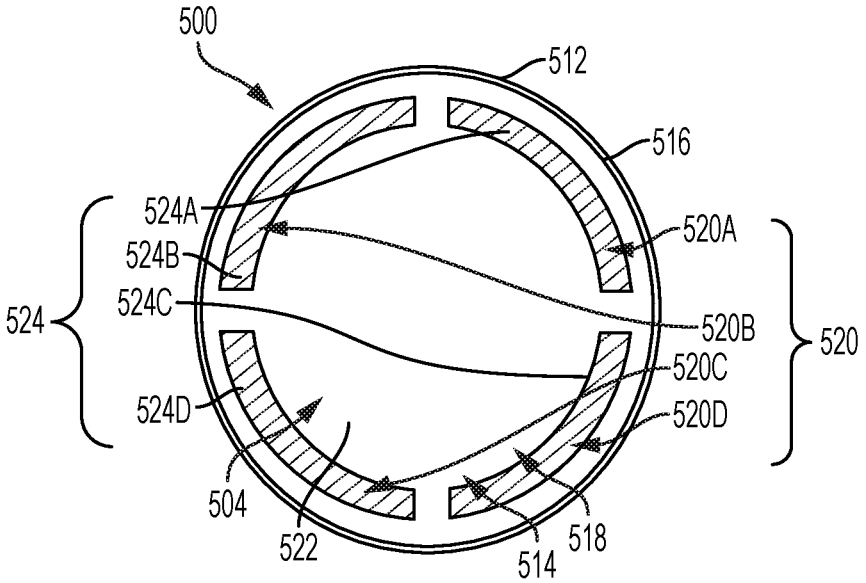

FIG. 5 illustrates a simplified top-down view of a cutting element 500 including a cutting table 504, in accordance with another embodiment of the disclosure. The cutting element 500 is similar to the cutting element 100 shown in FIGS. 1A and 1B, but in place of the ridge structure 120 (FIG. 1A) having a continuous, circular annular shape, the cutting table 504 of the cutting element 500 includes multiple ridge structures 520 substantially aligned with one another along a single (e.g., only one) radial position, and circumferentially extending across upper boundaries of a base structure 518 of the cutting table 504 at the single radial position. Each of the ridge structures 520 may be discrete from (e.g., separate from, non-continuous with) each other of the ridge structures 520.

As shown in FIG. 5, in some embodiments, the cutting table 504 includes four (4) the ridge structures 520 substantially aligned with one another along a single radial position. For example, the cutting table 504 may include a first ridge structure 520A, a second ridge structure 520B, a third ridge structure 520C, and a fourth ridge structure 520D. Upper surfaces 524 of the ridge structures 520 and an upper surface 522 of the base structure 518 form a non-planar cutting surface 514 of the cutting table 504. The first ridge structure 520A includes a first upper surface 524A, the second ridge structure 520B includes a second upper surface 524B, the third ridge structure 520C includes a third upper surface 524C, and the fourth ridge structure 520D includes a fourth upper surface 524D. In additional embodiments, the cutting table 504 includes a different quantity of the ridge structures 520, such as less than four (4) ridge structures 520 (e.g., three (3) ridge structures 520, two (2) ridge structures 520) or greater than four (4) ridge structures 520 (e.g., five (5) ridge structures 520, six (6) ridge structures 520, greater than six (6) ridge structures 520). The ridge structures 520 may be symmetrically distributed across an upper boundary of the base structure 518 of the cutting table 504, or may be asymmetrically distributed across the upper boundary of the base structure 518 of the cutting table 504.

Each of the ridge structures 520 may individually comprise an elongate structure (e.g., an elongate arcuate structure) exhibiting a desired geometric configuration (e.g., a desired shape, and desired dimensions). All the ridge structures 520 may exhibit substantially the same geometric configuration (e.g., substantially the same shape, and substantially the same dimensions), or at least one of the ridge structures 520 may exhibit a different geometric configuration (e.g., a different shape and/or one or more different dimensions) than at least one other of the ridge structures 520. In some embodiments, each of the ridge structures 520 exhibits substantially the same geometric configuration.

The ridge structures 520 may be separated (e.g., circumferentially separated) from one another by intervening portions of the upper surface 522 of the base structure 518. For example, as shown in FIG. 5, intervening portions of the upper surface 522 of the base structure 518 may circumferentially extend between the ridge structures 520. Each of the ridge structures 520 may be circumferentially separated from each other of the ridge structures 520 circumferentially adjacent thereto by substantially the same distance (e.g., such that the ridge structures 520 are substantially uniformly circumferentially spaced), or at least one of the ridge structures 520 may be circumferentially separated from one of the ridge structures 520 circumferentially adjacent thereto by a different distance than that between at least one of ridge structures 520 and another of the ridge structures 520 circumferentially adjacent thereto (e.g., such that the ridge structures 520 are non-uniformly circumferentially spaced). In some embodiments, the ridge structures 520 are substantially uniformly circumferentially spaced. In additional embodiments, the ridge structures 520 are non-uniformly circumferentially spaced.

In further embodiments, the cutting table 504 exhibits a different configuration than that depicted in FIG. 5. For example, the ridge structures 520 of the cutting table 504 may be geometrically configured and arranged to form a generally elliptical annular shape (e.g., similar to that of the ridge structure 220 shown in FIG. 2, but formed of and including multiple, discrete ridge structures 520 rather than a single, continuous structure). In further embodiments, the cutting table 504 of the cutting element 500 may include at least one additional ridge structure located at one or more different radial positions than the ridge structures 520. For example, the cutting table 504 may one or more additional ridge structures located at one or more radial positions radially inward of the ridge structures 520 (e.g., in an arrangement similar to that of the first ridge structure 320A and the second ridge structure 320B shown in FIG. 3), and/or one or more additional ridge structures located at one or more radial positions radially outward of the ridge structures 520.

Figure 6:
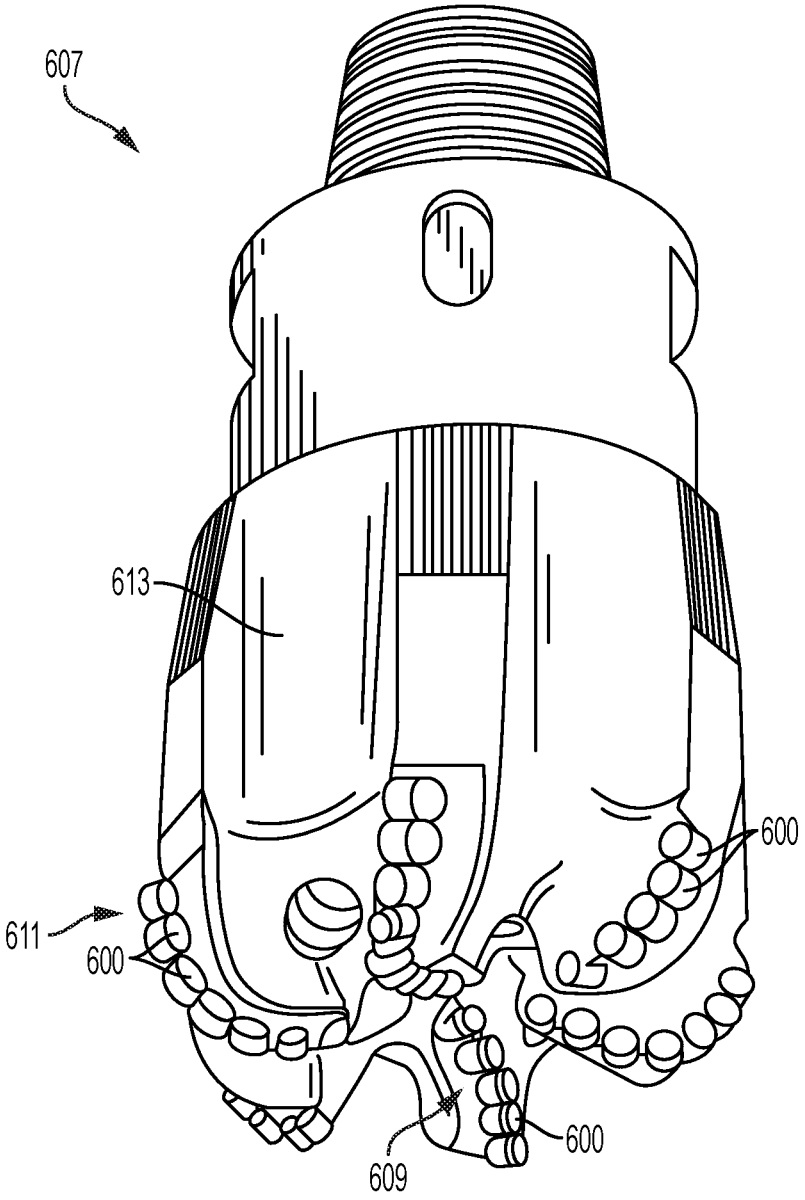
FIG. 6 is a perspective view of a fixed-cutter earth-boring rotary drill bit, in accordance with embodiments of the disclosure.

Cutting elements (e.g., the cutting elements 100, 200, 300, 400, 500) according to embodiments of the disclosure may be included in earth-boring tools of the disclosure. As a non-limiting example, FIG. 6 illustrates a rotary drill bit 607 (e.g., a fixed-cutter rotary drill bit) including cutting elements 600 secured thereto. The cutting elements 600 may, for example, be secured (e.g., welded, brazed, etc.) within pockets 609 in one or more blades 611 of a bit body 613 of the rotary drill bit 607. The cutting elements 600 may be substantially similar to one or more of the cutting elements 100, 200, 300, 400, 500 previously described herein. Each of the cutting elements 600 may be substantially the same as each other of the cutting elements 600, or at least one of the cutting elements 600 may be different than at least one other of the cutting elements 600. During use and operation, the rotary drill bit 607 may be rotated about a longitudinal axis thereof in a borehole extending into a subterranean formation. As the rotary drill bit 607 rotates, at least some of the cutting elements 600 may engage surfaces of the borehole and remove (e.g., shear, cut, gouge, etc.) portions of the subterranean formation.

The cutting tables, cutting elements, and earth-boring tools of the disclosure may exhibit increased performance, reliability, and durability as compared to conventional cutting tables, conventional cutting elements, and conventional earth-boring tools. The configurations of the cutting tables of the disclosure (e.g., including the configurations and positions of the ridge structures thereof) advantageously facilitate efficient impact resistance, spalling control, and cooling of the cutting tables during the use and operation of the cutting tables. The cutting tables, cutting elements, earth-boring tools, and methods of the disclosure may provide enhanced drilling efficiency as compared to conventional cutting tables, conventional cutting elements, conventional earth-boring tools, and conventional methods.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A cutting table for use in subterranean formations, the cutting table comprising:

a base structure of hard material comprising a side surface, an upper surface, and a cutting edge comprising at least one chamfered surface between the upper surface and the side surface; and at least one ridge structure of hard material vertically extending from the base structure and positioned horizontally inward of the at least chamfered surface of the cutting edge, the at least one ridge structure exhibiting an at least partially arcuate vertical cross-sectional shape, wherein the at least one ridge structure continuously extends in an arcuate path oriented substantially parallel to the side surface of the base structure.

2. The cutting table of claim 1, wherein the at least one ridge structure has a circular annular shape.

3. The cutting table of claim 1, wherein the at least one ridge structure comprises:

a first ridge structure extending in a first arcuate path; and a second ridge structure horizontally offset from the first ridge structure and extending in a second arcuate path.

4. The cutting table of claim 3, wherein the first ridge structure completely horizontally circumscribes the second ridge structure.

5. The cutting table of claim 3, wherein the first arcuate path of the first ridge structure exhibits a different curvature than the second arcuate path of the second ridge structure.

6. The cutting table of claim 1, wherein the at least one ridge structure comprises multiple ridge structures substantially aligned with one another along a single radial position.

7. The cutting table of claim 1, wherein the at least one ridge structure comprises a different volume percentage of hard material than the base structure.

8. The cutting table of claim 1, wherein the at least one ridge structure is integral and continuous with the base structure.

9. The cutting table of claim 1, wherein the upper surface of the base structure is substantially planar.

10. A cutting element for use in subterranean formations, the cutting element comprising:

a supporting substrate; and a cutting table over the supporting substrate, and comprising:

a base structure of hard material comprising a side surface, an upper surface, and a cutting edge comprising at least one chamfered surface between the upper surface and the side surface; and at least one ridge structure of hard material vertically extending from the base structure and positioned horizontally inward of the at least one chamfered surface of the cutting edge, the at least one ridge structure exhibiting an at least partially arcuate vertical cross-sectional shape, wherein the at least one ridge structure continuously extends in an arcuate path oriented substantially parallel to the side surface of the base structure.

11. The cutting element of claim 10, wherein the upper surface of the base structure and an upper surface of the at least one ridge structure together define a non-planar cutting surface of the cutting table.

12. The cutting element of claim 10, wherein:

a vertical cross-sectional width of the at least one ridge structure is less than or equal to about 4 millimeters; and a vertical cross-sectional height of the at least one ridge structure is less than or equal to about 2 millimeters.

13. The cutting element of claim 10, wherein the at least one ridge structure comprises multiple, discrete ridge structures vertically extending from the base structure.

14. An earth-boring tool comprising:

a structure; and at least one cutting element secured to within the at least one pocket in the structure, and comprising:

a supporting substrate; and a cutting table of hard material over the supporting substrate and comprising:

a base structure comprising a side surface, an upper surface, and a cutting edge comprising at least one chamfered surface between the upper surface and the side surface; and at least one ridge structure vertically extending from the base structure and positioned horizontally inward of the at least one chamfered surface of the cutting edge, the at least one ridge structure exhibiting an at least partially arcuate vertical cross-sectional shape, wherein the at least one ridge structure continuously extends in an arcuate path oriented substantially parallel to the side surface of the base structure.

* * * * *